US009212835B1

(12) United States Patent
Berens

(10) Patent No.: US 9,212,835 B1
(45) Date of Patent: Dec. 15, 2015

(54) HEATING AND COOLING SYSTEM UTILIZING A WATER SOURCE HEAT PUMP AND A SWIMMING POOL

(71) Applicant: Gregg Berens, Houston, TX (US)

(72) Inventor: Gregg Berens, Houston, TX (US)

( * ) Notice: Subject to any disclaimer, the term of this patent is extended or adjusted under 35 U.S.C. 154(b) by 0 days.

(21) Appl. No.: 14/487,674

(22) Filed: Sep. 16, 2014

Related U.S. Application Data

(63) Continuation-in-part of application No. 13/224,809, filed on Sep. 2, 2011, now abandoned.

(51) Int. Cl.

| | |
|---|---|
| ***E04H 4/12*** | (2006.01) |
| ***F25B 27/00*** | (2006.01) |
| ***F25B 30/06*** | (2006.01) |
| ***F24F 5/00*** | (2006.01) |

(52) U.S. Cl.
CPC *F25B 27/00* (2013.01); *E04H 4/12* (2013.01); *F24F 5/0071* (2013.01); *F25B 30/06* (2013.01); *F25B 2313/002* (2013.01); *F25B 2313/004* (2013.01); *F25B 2339/047* (2013.01)

(58) Field of Classification Search
CPC ..... E04H 4/00; E04H 4/12; E04H 4/129; F25B 2313/004; F25B 2339/047; F24F 5/0071; Y02B 30/12; F24D 11/0214; F24D 17/0078; F24H 4/04
See application file for complete search history.

(56) References Cited

U.S. PATENT DOCUMENTS

| | | | | | |
|---|---|---|---|---|---|
| 4,238,933 | A * | 12/1980 | Coombs | 62/238.7 |
| 4,279,128 | A * | 7/1981 | Leniger | 62/238.6 |
| 5,287,567 | A * | 2/1994 | Eash et al. | 4/493 |
| 6,122,922 | A * | 9/2000 | Conner | 62/91 |
| 2004/0069001 | A1 * | 4/2004 | Taylor et al. | 62/238.1 |
| 2008/0022709 | A1 * | 1/2008 | McKee | 62/314 |
| 2010/0242517 | A1 * | 9/2010 | Johnson | 62/259.4 |

* cited by examiner

*Primary Examiner* — Mohammad M Ali
*Assistant Examiner* — Christopher R Zerphey
(74) *Attorney, Agent, or Firm* — Egbert Law Offices, PLLC

(57) ABSTRACT

A heating and cooling system includes a swimming pool, a pump connected to the swimming pool, a pool cooler connected to the pump so as to cool water passing from the pump, a water source heat pump cooperative with the pump so as to receive water as passed by the outlet pipe of the pump, a valve mechanism connected to the outlet of the pump so as to control the flow of water toward the pool cooler and the water source heat pump, and a pressure control valve cooperative between the valve mechanism in the inlet line of the pool cooler so as to limit a pressure of the water flowing from the valve mechanism toward the inlet line of the pool cooler. A pressure control is connected to the outlet line of the pool cooler so as to reduce a pressure of the water flowing from the outlet line to the pump.

18 Claims, 2 Drawing Sheets

HEATING AND COOLING SYSTEM UTILIZING A WATER SOURCE HEAT PUMP AND A SWIMMING POOL

CROSS-REFERENCE TO RELATED APPLICATIONS

The present application is a continuation-in-part of U.S. patent application Ser. No. 13/224,809, filed on Sep. 2, 2011, and entitled "Air Conditioning and Pool Cooling System", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to heating and air-conditioning systems. More particular, the present invention relates to the use of water source heat pumps that are used for the purpose of heating and cooling an interior space. Additionally, the present invention relates to the use of water source heat pumps that effectively use water from a swimming pool in order to achieve the requisite heating and cooling effect. The present invention further relates to the use of pool coolers for the purpose of cooling the swimming pool water in conjunction with the use of a water source heat pump.

2. Description of Related Art Including Information Disclosed Under 37 CFR 1.97 and 37 CFR 1.98.

Human beings are know for their ability to adapt to their environment or, to adapt the environment to them. One example of this quality is continued expansion of human population into areas previously deemed inhospitable to human life. In order to survive in these hot climates, most structures that are designed for human occupation are provided with one or more systems for cooling the air within the structure. Some of the various types of systems used to cool the area inside a structure are typically rated by using a system which assigns an Energy Efficiency Ratio rating or number to the system. A higher Energy Efficiency Ratio rating indicates a more efficient system when compared to a system having a lower Energy Efficiency Ratio.

One popular method of cooling the air inside a structure that has been adopted in many hot environments is the evaporative cooler. Evaporative coolers use a simple combination of a water pump, absorbent cooling pads, and a fan to provide cool air. Using basic principles of gravity and evaporation, air is cooled by forcing it through the evaporative cooler. Water is pumped through water-retaining pads which line the interior surface of the evaporative cooler and the outside air is drawn into the evaporative cooler by a large blower fan. By drawing the outside air through the water-soaked cooling pads, heat is transferred from the air to the water as water evaporation occurs and the cooled air is blown into the structure, thereby cooling the interior of the structure.

To overcome the limitations associated with evaporative coolers, persons living in hot environments have turned to refrigerated air-conditioning systems to cool the air inside a structure. Instead of using the principals of evaporation, traditional refrigerated air-conditioning systems use the properties of refrigerant gases, such as freon, to the cool the temperature of the air. While very effective, refrigerated air-conditioning systems suffer from several undesirable characteristics. Foremost, these systems are relatively expensive to operate when compared to nominal operating costs associated with most evaporative coolers. During the hottest part of summer, the cooling costs associated with supplying electricity for a refrigerated air-conditioning system for even modest-sized homes can become exorbitant. Secondly, the compressors, fans, and motors used in typical residential air-conditioning systems are very loud and can contribute to a high level of ambient noise.

Water source heat pumps are becoming more common as the cost of energy and equipment maintenance rises. When properly deigned and installed, they not only reduce energy use, but lower maintenance costs and extend equipment life since they have no exposed outdoor equipment. They are very simple devices and hence only a slight difference from traditional heat pumps. Although they have an added cost of a ground loop, the water source heat pump itself can generally have a lower cost than traditional HVAC systems. In a traditional ground source heat pump, a piping loop is buried in the ground which is considerably warmer than the outdoor air in the winter. Water is circulated through the loops and into the building where the heat pump removes the heat from the water and delivers it to the air. Since water entering the heat pump is relatively warm (since it is in contact with warm ground), the coefficient of performance is much higher than a heat pump that uses cold outside air as a heat source. The process is reversed in cooling. Heat is removed from inside air and delivered to the water loop which rejects this heat to the ground. This provides high cooling efficiency since the ground is much cooler than the air during the summer.

Water source heat pumps have been adapted whereby a coil is submerged in a lake so as to replace the ground loop. These water source heat pumps can be very efficient if the lake is more than 30 feet deep. Typically, such bodies of water will have an area of greater than an acre.

The water source heat pump utilizes a compressor that is driven by an electric motor (typically located indoors). A condenser coil is provided with the tubing for water flow and tubing for refrigerant flow. A circulation pump moves water through the condenser and the outdoor water loop. An expansion device (usually located indoors) will lower the system pressure. An evaporator (or indoor) coil with tubing and with many fins serves to cool and dehumidify the air. An indoor fan is used to circulate air over the cold evaporator tubing and fins. A refrigerant fluid operates at the required pressures and temperatures. An outdoor water loop is provided in the nature of a ground loop, a lake loop or a water well. A compressor "sucks" the refrigerant through the tubing in the evaporator coil. This action causes the liquid refrigerant to "evaporate" and become cold. The evaporating refrigerant within the tubes cools air being circulated over the outside of the tube and fins by the indoor fan. In order to remove the refrigerant, it must be raised to a higher pressure by the compressor. The compressing causes the refrigerant to become hot. The hot refrigerant is sent through the outside tubing of a tube-inside-tube water coil condenser. Water is circulated by the pump through the inside tube and cools the refrigerant and causes it to return to a liquid. The liquid refrigerant leaving the condenser passes through an expansion device which lowers the refrigerant pressure before it returns to repeat the cycle.

In hot climate environments, many homeowners have swimming pools with a quantity of water therein. Heretofore, the swimming pool lacks a sufficient depth and area to provide an effective water source for the water source heat pump. Additionally, homeowners often prefer to have cooler water in the swimming pool. The water will generally rise to the ambient temperature over a period of time. Ultimately, if the temperature of the water is too high, it will be uncomfortable for use.

Water source heat pumps also have a problem when operating in high temperature conditions. This especially true if the humidity level is too high. The air conditioning system will need to run longer so as to provide a comfortable temperature within a conditioned space. A geothermal system with a water source heat pump will not work properly and efficiently. If any attempt is made to utilize the swimming pool for providing the cooling temperatures to the ground loop of a water source heat pump, the temperature will not function properly with such a small depth and small area of swimming pool. When the temperature is above 95° F., the water source heat pump system pressure will go high. As such, it will be similar to a clogged air-cooled condenser and, thereby, lose all efficiency. Most air conditioning systems that are air-cooled are only designed for 95° or less.

The air conditioning system includes four components. First, there is a compressor that compresses the hot superheated vapor coming from an evaporator. The condenser serves to cool the water or air so as to cause the refrigerant to change state to a high pressure liquid. This rejects the heat from the house. An expansion valve or orifice meters the refrigerant liquid to the evaporator. The evaporator changes the refrigerant to a vapor-absorbing heat from a conditioned space. If the head pressure goes too high, those system will not function properly since there is no more capability to reject any additional heat. As such, this occurs when heat is removed from the house to the swimming pool or reservoir. As such, a need has developed whereby a swimming pool can be used with a water source heat pump so as to effectively provide for cooling of the house or building and for the cooling of a swimming pool.

In the history of refrigeration and air-conditioning, the first metering device which separates the low side from the high side of the mechanical system has a manual hand valve that was used to control the flow and pressures on large high tonnage refrigeration and air-conditioning systems. This will maintain a constant pressure on the evaporator or multiple evaporators. A hand valve would have to be turned or modulated to a fixed position. This maintains the proper liquid flow to the evaporator or evaporators. If opened too far, the evaporator will have too much liquid on it and the system will not function properly. On the other hand, the valve is not opened enough, the evaporator or evaporators will be starved with not enough refrigerant and the system will not function properly.

Today, small refrigeration and air-conditioning systems use a thermostatic expansion valve to maintain a constant flow in a mechanical system automatically.

In the past, various patents have issued relating to the use of swimming pool water in association with heating and air conditioning systems. For example, U.S. Pat. No. 3,498,072, issued on Mar. 3, 1970 to R. C. Stiefel, shows an air conditioning system for cooling the air in a house. The system includes a water-cooled condenser and an evaporator. The water for cooling the condenser is pumped from a swimming pool. The swimming pool water is warmed and, simultaneously, the condenser is cooled.

U.S. Pat. No. 3,976,123, issued on Aug. 24, 1976 to T. D. Davies, shows a refrigeration system for controlled heating using rejected heat of an air conditioner. The rejected heat is used to heat a second medium, such as water for a swimming pool. A control is provided to maintain the temperature of the pool within a given range without degrading the performance of the air conditioning system. A heat exchanger is provided to place the second medium in heat-exchange relationship with the refrigerant. The heat exchanger is placed between the condenser unit and the expansion valve of the refrigeration system.

U.S. Pat. No. 3,995,443, issued on Dec. 7, 1976 to R. O. Iversen, teaches an air conditioning system in which a liquid stream is cooled in an air cooling tower outside the building by contact with the ambient or outside air. This liquid stream is circulated in a cyclical flow directly between the heat exchangers or induction unit coils in the building and the cooling tower outside the building.

U.S. Pat. No. 4,019,338, issued on Apr. 26, 1977 to E. E. Poteet, shows a heating and cooling system for heating water contained in a swimming pool while providing a means for cooling or heating the interior of a building. The system includes a compressor connected through suitable conduits to a condenser located in a swimming pool and an evaporator such that, when a fluid heat-transfer medium is communicated under high pressure to the condenser, heat is given off thereby. The evaporation of the medium in the evaporator results in a reduction in temperature surrounding the evaporator so as to cool the interior of a building. A second condenser is provided with suitable valving and conduits for selectively communicating the second condenser to the compressor and the evaporator whereby the building may be cooled while not heating the water in the pool.

U.S. Pat. No. 4,907,418, issued on Mar. 13, 1990 to L. C. DeFazio, describes swimming pool heating system that includes, in sealed tank, a refrigerant cooling coil system. A water flow distribution manifold is located within the refrigerant cooling coil system. Cool swimming pool water is pumped through the water flow manifold such that it imparts a cyclical flow of water over the refrigerant cooling coil system. The warmth of the warmed refrigerant is imparted to the cool swimming pool water and the warmed swimming pool water then exits the water flow manifold and is returned to the swimming pool.

U.S. Pat. No. 5,560,216, issued on Oct. 1, 1996 to R. L. Holmes, teaches a combination air conditioner and pool heater. The air conditioner is a conventional house air conditioner which includes a condensing unit located outside the house. The air conditioning includes a compressor, an air-cooled coil, and a external fan directing air across the air-cooled coil. An evaporator unit is located in the house. The evaporator unit includes an evaporator coil and an internal fan for blowing air across the evaporator coil to discharge cool air into the house. The pool is a conventional outdoor swimming pool having a circulating pump for withdrawing water from the pool and for returning water to the pool. A coaxial heat exchanger coil has an outer conduit and an inner conduit disposed in heat exchange relationship with each other. The outer conduit is connected to a discharge pipe for discharging water back into the pool.

U.S. Pat. No. 5,802,864, issued on Sep. 8, 1998 to Yarbrough et al., provides a heat transfer system for use in cooling and dehumidifying an interior space. The system incorporates three primary heat transfer coils in a mechanical refrigeration cycle to provide comfortable cooling to the interior space while rejecting heat to the two primary condensing mediums. The heat transfer system functions by transferring heat from the atmosphere to a pool and, thereby, serves as a pool heater. In a first operating mode, heat is transferred from an interior space to the ambient atmosphere. In a second operating mode, heat is transferred from an interior space to pool water. In a third operating mode, heat is transferred from the ambient atmosphere to pool water. U.S. Pat. No. 5,901,563, issued on May 11, 1999, also to Yarbrough et al., shows a similar system. Furthermore, U.S. Pat. No. 6,253,564, issued on Jul. 3, 2001, also to Yarbrough et al., shows a similar system.

U.S. Pat. No. 5,911,745, issued on Jun. 15, 1999 to L. D. Conner, provides a method and apparatus for cooling air and water. The apparatus uses a combination of an evaporative cooler, a refrigerated air system with a water-cooled condenser, a swimming pool pump, and a swimming pool or other bulk water storage container. A pump is used to supply water to the evaporative cooler and to the water-cooled condenser from the swimming pool. After the swimming pool water has been supplied to the other components in the system, it is returned to the swimming pool. During cooler weather, the output air from the evaporative cooler is supplied to a series of ducts and is used to cool the interior of a structure, such as a home. When the outside ambient temperature and/or humidity levels exceeds the capabilities of the evaporative cooler, the output air from the evaporative cooler is re-directed to the attic space of the structure and the refrigerated air from the refrigerated air system is used to cool the interior of the structure.

U.S. Pat. No. 6,688,129, issued on Feb. 10, 2004 to R. S. Ace, teaches an excavationless geothermal system for heating and cooling. This system includes a potable water storage container that receives water from a water supply through a supply line and a reversible water meter. The water in the storage container is circulated through a heat pump. When the temperature of the water in the container is increased or decreased by the heat pump, the water is returned to the supply through the reversible meter.

U.S. Pat. No. 6,955,065, issued on Oct. 18, 2005 to Taylor et al., describes an air conditioning system employing air condensers and/or water condensers. These air condensers and water condensers are coupled to a water source. The water source includes a water-to-air heat exchanger.

It is an object of the present invention provide a system and process that effectively cools pool water.

It is another object of the present invention provide a system and process which provides water to a water source heat pump.

It is another object of the present invention to provide a system and process that maximizes the efficiency of heating and air-conditioning systems.

It is still a further object of the present invention to provide a process and system that provides heating or cooling to the interior space of a building while, at the same time, cooling pool water.

It is another object of the present invention provide a system and process which serves to minimize utility bills to the homeowner.

It is still a further object of the present invention to provide a system and process which is easy to install, easy to use and relatively inexpensive.

These and other objects and advantages of the present invention will become apparent from a reading of the attached specification and appended claims.

BRIEF SUMMARY OF THE INVENTION

The present invention is a heating and cooling system that comprises a swimming pool having water therein, a pump in fluid communication with the water in the swimming pool so as to draw water from the swimming pool therethrough, a pool cooler suitable for cooling water passing therethrough, a water source heat pump cooperative with the pump so as to receive water as passed by an outlet pipe of the pump, a valve mechanism connected to the outlet of the pump so as to control a flow of water toward the pool cooler and to the water source heat pump, and a pressure control valve cooperative between the valve mechanism and an inlet line of the pool cooler so as to limit a pressure of the water flowing from the valve mechanism toward the inlet line of the pool cooler to pressure of between 8 and 10 p.s.i.g. and assure that at least 2 p.s.i.g. water flows from the valve mechanism to the water source heat pump. The pool cooler has an inlet line and an outlet line connected thereto. The outlet line communicates with the inlet pipe of the pump. The outlet pipe has a pressure control thereon so as to reduce a pressure of the water flowing from the outlet line to the inlet line of the pump. The inlet line has a pressure valve thereon. The water source heat pump has a first line and a second line extending therefrom. The first line has a modulating valve thereon so as to control a flow of the water to the water source heat pump. The water source heat pump has a condenser, an evaporator and a compressor with a reversing valve cooperative therewith.

A bypass line is connected to the inlet line of the pool cooler and downstream of the pressure control valve so as to allow a flow of water from the inlet line to pass therethrough. The inlet line of the pool cooler has a pressure valve thereon so as to reduce a pressure of the water flow to between 4 and 6 p.s.i.g. The pressure control of the outlet line of the pool cooler reduces a pressure of the water flowed to the pump to between 0.25 p.s.i.g. and 0.50 p.s.i.g.

A filter is cooperative with the valve mechanism so as to filter the pool water from the pump. The filter has an outlet suitable for passing between 8 and 9 p.s.i.g. of water therefrom. The outlet line of the pool cooler has a modulating valve thereon suitable for blocking the flow of water through the outlet line to the inlet pipe of the pump when the heat pump is in the heating mode. The reversing valve is movable between a first position and a second position. The first position serves to pass the refrigerant through the condenser and then to the evaporator during a cooling mode. The second position serves to pass the refrigerant to the evaporator and then to the condenser during a heating mode. The modulating valve of the water source heat pump serves to limit a flow of water to the water source heat pump to between 1.5 to 2 gallons per minute per ton.

A valve controller is connected to a conduit extending from the swimming pool and to the inlet pipe of the pump. The valve controller is cooperative with the outlet line of the pool cooler so as to selectively pass cool water from the pool cooler to the swimming pool. The valve mechanism has a controller cooperative therewith so as to selectively cause water to flow from the water source heat pump to the pool cooler or to cause water to flow from the water source heat pump to the swimming pool. The controller is cooperative with the reversing valve of the water source heat pump so as to control the flow of refrigerant to the evaporator so as to absorb heat from the water upon a demand for heat. A temperature sensor is cooperative with the water in the swimming pool so as to sense a temperature of the water therein. The temperature sensor is cooperative with the valve mechanism so as to cause a blockage of the flow of water through the outlet line of the pool cooler when a sensed temperature of the water in the swimming pool is less than 85° F. The water source heat pump is a single water source heat pump.

The present invention is also a process that comprises the steps of: (1) pumping water from a swimming pool toward a water source heat pump; (2) diverting at least a portion of the flowed water into an inlet line of the pool cooler in which the pressure is between 8 and 10 p.s.i.g.; (3) reducing the pressure of the diverted portion to between 6 and 8 p.s.i.g.; (4) flowing the reduced pressure water to a pool cooler was so as to cool the water; and (5) passing the cooled water to the swimming pool when the temperature of the water in the swimming pool is greater than 85° F. The remaining portion of the diverted water is passed toward the water source heat pump.

The process of the present invention further includes passing the remaining portion through a condenser so as to condense the refrigerant, passing the condensed refrigerant through an evaporator of the water source heat pump so as to evaporate the condensed refrigerant, compressing the evaporated refrigerant so as to compress the evaporated refrigerant so as to cause a cooling effect, and discharging the compressed evaporated refrigerant back to the condenser. The process further includes passing the remaining portion through an evaporator so as to evaporate the refrigerant, condensing the evaporated refrigerant so as to condense the evaporated refrigerant, compressing the condensed refrigerant so as to compress the evaporated refrigerant so as to cause a cooling effect, and discharging the water to the swimming pool.

The process of the present invention further includes reducing a pressure of the diverted portion to between 4 and 6 p.s.i.g. prior to entering the pool cooler. The flow of cold water is blocked when the sensed temperature of the pool water is less than 85° F. The pool cooler is constantly operated regardless of the sensed temperature of the water in the swimming pool.

This foregoing Section is intended describe, with particularity, the preferred embodiment of the present invention. It is understood that modifications to this preferred embodiment can be made within the scope of the present invention without departing from the invention. As such, the Section should not be construed, in any way, as limiting of the broad scope of the present invention. The present invention should only be limited by the following claims and their legal equivalents.

DETAILED DESCRIPTION OF THE INVENTION

Figure 1:
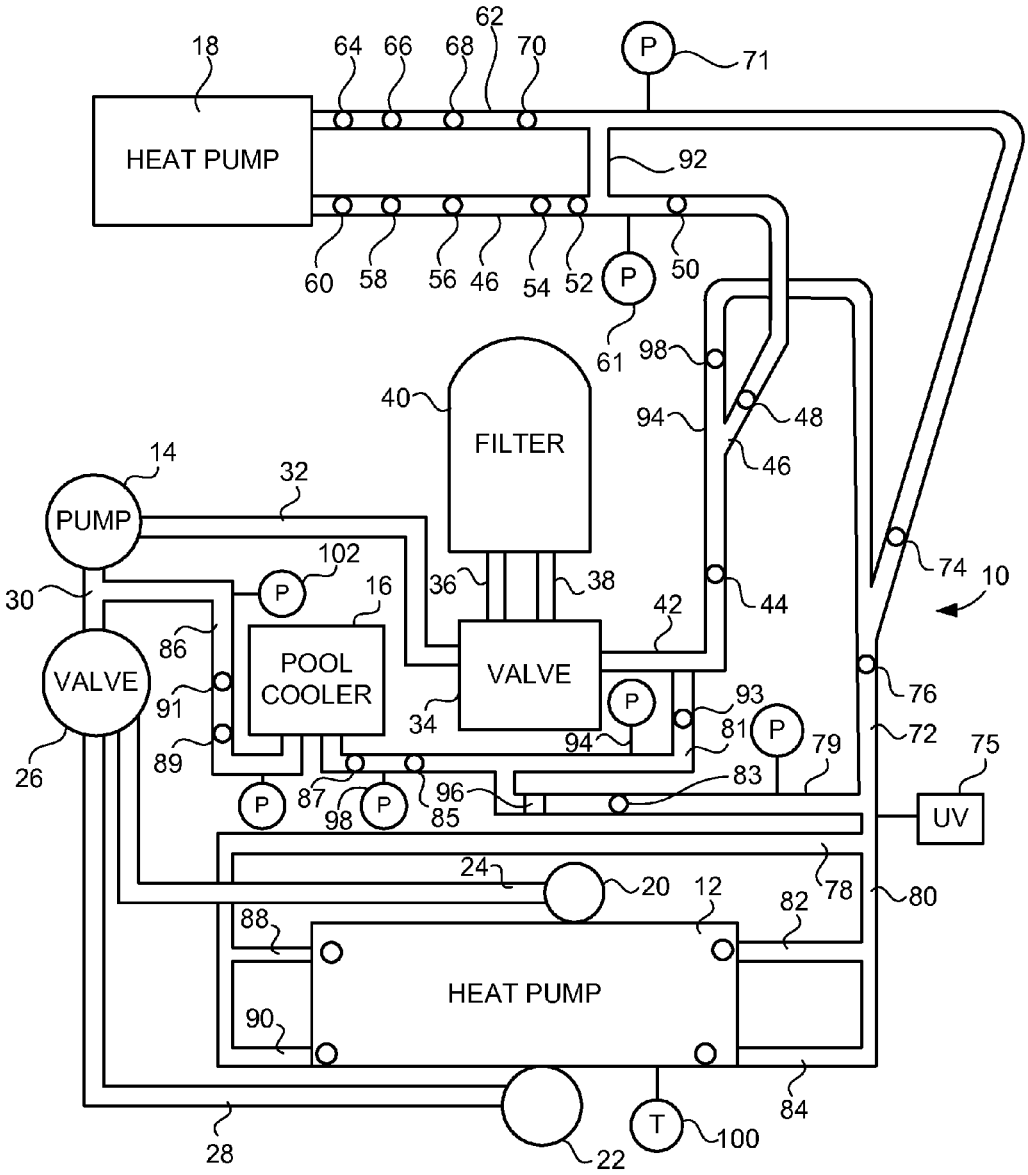
FIG. 1 is a diagrammatic illustration of the system and process of the present invention.

Referring to FIG. 1, there is shown the heating and cooling system 10 in accordance with the preferred embodiment of the present invention. The system 10 includes a swimming pool 12, a pump 14, a pool cooler 16 and a water source heat pump 18.

The swimming pool 12 is in the nature of a conventional household swimming pool. The pool 12 has a relatively shallow depth and a relatively small surface area. A pair of skimmers 20 and 22 are positioned in association with the pool 12. The skimmers 20 and 22 are conventional skimmers which serve to pull water from the pool 12 outwardly therefrom. Skimmer 20 is connected by a line 24 to a valve controller 26. Similarly, the skimmer 22 is connected by a line 28 to the valve controller 26. As such, the skimmers 20 and 22 serve to draw the pool water from the pool 12 toward the valve controller 26. Lines 24 and 28 serve as a "first" conduit of the water from the pool 12 toward the pump 14.

The valve controller 26 is a three-way valve. The valve can be suitably opened or closed as desired. Under certain circumstances, it is desired to clean the pool 12. As such, the valve controller 26, on one side, will be in a closed configuration so as to shut off line 28 for more pressure on skimmer 20 and its associated line 24. When the valve controller 26 is in an open configuration, the water from the pool 12 will be drawn by the lines 24 and 28 by action of the pump 14 so as to pass into an inlet pipe 30 toward the pump 14.

The pump 14 draws the water through the inlet pipe 30 from the pool and from the pool cooler 16 through pool cooler outlet line 86, and passes the warm pool water along the outlet pipe 32 toward a valve mechanism 34. The valve mechanism 34 has an inlet 36 and outlet 38 directed toward a filter 40. The filter 40 is in the nature of a conventional pool filter. Filter 40 serves to remove debris from the pool water passing through the outlet pipe 32 of the pump 14. Through the action of the valve mechanism 34, the pool water is directed into the filter 40. The filtered water then passes from the filter 40 through the outlet 38 toward the valve mechanism 34. The valve mechanism can be in the nature of a four-way valve. In the closed position, the valve mechanism 34 can shut-off the system for maintenance, repair, back-flushing or other purposes.

The valve mechanism 34 is connected to another line 42 extending from the outlet pipe 32 of pump 14. A union 44 is provided along line 42 for servicing and maintenance. The line 42 branches to a pathway 46 which delivers the filtered pool water toward the heat pump 18. A shut-off valve 48 is provided on the pathway 46 so as to open or close in accordance with requirements of the system. Ultimately, the pathway 46 will serve as an inlet of the water toward the heat pump 18 and to the pool cooler through the inlet line 81. A water valve 50 is provided along the pathway 46. Similarly, a pressure control modulating valve 52 is installed along the pathway 46. A shut-off valve 54 is located on the pathway 46 between the valve mechanism 34 and the heat pump 18. Various transducers such as flow meter 56, pressure gauge 58, and temperature gauge 60 are also cooperative with the pathway 46 so that the water passing to the heat pump 18 can be suitably monitored as required. A pressure tap 61 is provided to measure the fluid pressure leading toward the heat pump 18.

Importantly, the modulating valve 52 serves to adjust pressure of the fluid directed toward the heat pump 18. Modulating valve 52 is a hand modulating valve so as to maintain 2 to 3 p.s.i.g. of fluid pressure and to maintain between a flow rate to the heat pump 18 of between 1.5 to 2 gallons per minute per ton. For example, if the heat pump is a four ton heat pump, then the modulating valve 52 will assure between 6 and 8 gallons per minute to the heat pump 18. These pressure requirements are critical to the functioning of the present invention. If too little fluid pressure or too much fluid pressure is delivered to the heat pump 18, then the heat pump may not operate properly.

Figure 2:
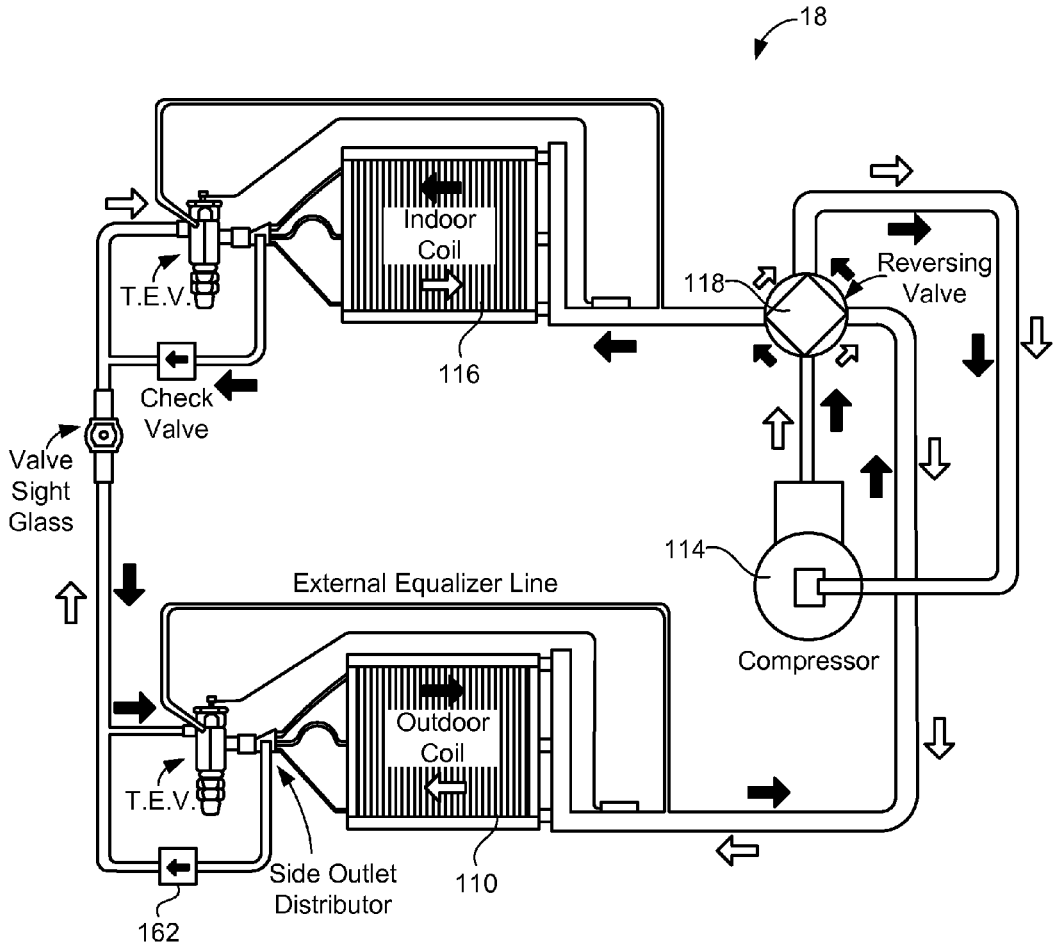
FIG. 2 is a diagram showing the operation of the water source heat pump, and in particular the reversing valve of the water source heat pump, in accordance with the teachings of the present invention.

The heat pump 18 is a water source heat pump of a configuration similar to that described in FIG. 2 herein. The pool water passing through the valve controller 26 by way of pump 14 through the outlet pipe 32 is delivered to the heat pump initially at ambient temperatures. The heat pump 18 will use the water so as to provide cooling temperatures in the nature of a standard water source heat pump. Heat pump 18 has an outlet line 62 extending therefrom. Outlet line 62 also includes a suitable temperature gauge 64, a pressure gauge 66, a flow meter 68 and a shut-off valve 70 thereon. Another pressure tap 71 is provided to measure and control the fluid pressure exiting the heat pump 18. Pressure taps 61 and 71 are carefully balanced so as to achieve a high energy efficiency rating. Conduit 62 extends therealong so that the warmed water from the heat pump 18 passes therethrough toward line 72. Line 72 includes a shut-off valve 74 and a union 76 thereon. Ultimately, the conduit 72 will include a first branch 78 which extends to inlet lines 88 and 90 of the pool 12 and another branch 80 which will extend toward the inlet lines 82 and 84 of the pool 12.

Importantly, in the present invention, the pool cooler 16 is provided so as to cool the temperature of the water. In particular, the pool cooler 16 delivers a stream of swimming pool water to a distribution head. The distribution head includes a plurality of dispensing apertures for converting the stream of swimming pool water into a plurality of smaller streams. A fill medium is positioned immediately beneath the distribution head through which the smaller streams of water can pass where they are atomized into smaller droplets. An electric fan is positioned above the distribution head for forcing ambient air through the film medium to invoke evaporative cooling of the atomized water.

As can be seen in FIG. 1, a line 79 connects the conduit 72 to the inlet line 81 of the pool cooler 16. A check valve 83 is positioned in bypass line 79 so as to cause a unidirectional flow of water therethrough. The inlet line 81 communicates between the line 42 and the pool cooler 16. A check valve 85 and a modulating valve 87 are positioned in the inlet line 81 so as to control the flow of water therethrough. The line 79 has a diameter of one inch.

The valve 93 in the inlet line 81 controls the water to the pool cooler and the water to the heat pump. The valve 93 is a hand valve. A pressure gauge 94 is cooperative at the inlet line 81 so as to measure a pressure of the water within the line 81.

Importantly, the valve 93 controls the flow of pressure passing from the line 42 into the inlet line 81 of the pool cooler 16 such that only 8 to 10 p.s.i.g. of pressure passes into the inlet line 81. The remaining fluid is diverted through the line 42 and toward the heat pump. The modulating valve 52 will assure that between 2 and 3 p.s.i.g. of pressure is maintained to the heat pump 78 in the manner described herein previously. Ultimately, the outlet pressure from the filter 40 passing through the outlet line 38 will be between 8 and 9 p.s.i.g. Pressure control in the line 81 is critical to the success of the present invention. Ultimately, this valve is used in association with a two inch diameter pipe. The pressure gauge 94 serves to assure the user that the pressure in this area is between 8 and 10 p.s.i.g. A pressure port 96 is provided along the bypass line 79. This pressure port 96 can serve to bleed off certain pressure passing through the inlet line 81. As such, between 6 and 8 p.s.i.g. of pressure will be delivered to the check valve 85. Another pressure gauge 98 is positioned on the downstream side of the inlet line 81 from the check valve 85. Ultimately, the pressure in the area between the check valve 85 and the hand valve 87 will be between 4 and 6 p.s.i.g. The hand valve will, unexpectedly, cause the pressure passing directly to the pool cooler 16 be of a pressure of between 0.25 p.s.i.g. and 0.50 p.s.i.g. As such, the pressure of the fluid passing through the inlet line 81 will be of a relatively high volume and a low-pressure. As a result, the wand of the pool cooler 16 will continue to rotate even under those circumstances in which no cooling effect is required.

If the pressure passing through valve 93 is not set correctly, then the air conditioning effect of the heat pump 18 will not work properly and the pool cooler will not work properly. If pressure in excess of 0.50 p.s.i.g. is delivered to the pool cooler 16, then the pool pump 14 would have a tendency to overamp. The decreased pressure and the increased flow rate serve to make both the pool cooler 16 and the pump 14 work properly. As such, this arrangement achieves the unexpected energy efficiency.

Valve 87 on the inlet line 81 and the valve 91 on the outlet line 86 are available to modulate or close down when the pool cooler 16 is not in use. As such, when the temperature of the water as sensed by temperature sensor 100 associated with the pool 12 senses that the water in the pool 12 is in excess of 85° F., then the valves will properly open so that the cooling water can be delivered to the pool 12. If the temperature sensor 100 senses that the temperature of the pool water is less than 85° F., then the valve 91 on the outlet line 86 can close so as to prevent water from the pool cooler 16 from being delivered to the pool. As a result, the skimmer and/or the heat pump can run when the pool cooler 16 is not in use.

A pressure gauge 102 is applied to the outlet line 86 of the pool cooler 16. Pressure sensor 102 will sense the amount of pressure that is passing through the outlet line 86. Initially, the pressure of the water passing from the pool cooler 16 will be approximately 4 p.s.i.g. The valve 89 can be suitably adjusted such that this pressure is reduced to between 0.25 to 0.5 p.s.i.g. As such, a proper amount of liquid can be delivered toward the pump through the outlet pipe 86. The lower pressure keeps the pool pump 18 from overamping.

As can be seen in FIG. 1, the line 79 and the inlet line 81 are connected to the pool cooler 16. As such, the water, which has been warmed by the heat pump 18, can be cooled to the pool cooler 16 and delivered along line 86 to the inlet pipe 30 of the pump 14. Line 86 has a shut off valve 89 and a check valve 91 thereon so as to control the flow of water therethrough. In this configuration, the cooled warmed water from the heat pump is mixed with the pool water from the pool 12 prior to passing to pump 14. The cooled water from the pool cooler 16 is mixed so as to lower the temperature of the water passing from the pool 12 toward the heat pump 18. As such, relatively cool water is delivered to the heat pump. This, as described herein previously and as will be described hereinafter, improves the efficiency of the heat pump 18 allows the heat pump 18 to operate in those circumstances where the ambient temperature is greater than 95° F.

Additionally, a portion of the flow of the water through the line 78 is delivered through the inlets 88 and 92 the pool 12. Once again, pool water is cooled by the action of the pool cooler 16. The water passing from the pool cooler 16 will have a temperature that is less than the temperature of the water in the pool. Experiments with the present invention of indicated that the water in the pool 12 can be cooled by as much as 10 to 15° by the action of the system 10 of the present invention.

An ultraviolet light is positioned before conduits 78 and 80. The water will pass through the conduit 72 and through the ultraviolet light 75. This occurs before the water goes to the return branches of the pool 12. Whenever geothermal water source heat pumps have been used, the electrolysis of either copper or cupro-nickel occurs. This has been a problem by using a pool system that can include chlorine and/or salt water. The chlorine and/or salt water can void the warranty. The water-cooled condenser is not suitable for use with chlorinated or salt water. Less than 0.20 parts per million is the largest quantity that is allowed for copper. Cupra-nickel of no more than 150 p.p.m. can be used at 50° F. The ultraviolet light 75 allows the ability to go down to 0.5 which is approximately the same as drinking water. This results in the use of 85 to 90% less chemicals. This is efficient for the environment and can save money to the consumers. The pool water is then suitable for the water-cooled condenser.

In those circumstances where the heat pump 18 has effectively cooled the interior of the building or home, the modulating valves 54 and 70 can be suitably adjusted. These valves 54 and 70 can also be closed so that the heat pump 18 can be cleaned or maintained. As such, the cooled water, as passed by the pump 14, will bypass the heat pump 18 through the bypass line 92 in order to maintain proper pressure in the heat pump 18. The cooled water can then be passed directly back to the pool cooler 16 and to the pool 18 through the inlets 82 and 84.

In those circumstances where the heat pump is not required, the valve 48 can be closed so that the flow of the cooled water will pass along line 94 back through the conduit 72 and to the pool 12. As such, the water in the pool 12 is effectively cooled slowly by the action of the pool cooler 16. In this circumstance, the pool cooler 16 can operate in isolation from the heat pump 18.

The heat pump 18 is a water source heat pump which serve to accept water in which there is no defrost during the heating cycle. Everything is carried out through a thermostat in order to turn the heat pump on or off. The water system is carried out to an electrical panel built separately. There is a low voltage from inside the air handler and there is a low voltage from the transformer in the electric panel.

FIG. 2 illustrates the operation of the heat pump 18. As can be seen in FIG. 2, during the cooling cycle, the outdoor coil 110 is used as a condenser and the outdoor thermostatic expansion valve 112 does not function. The line to which the thermostatic bulb is attached becomes the discharge line from the compressor 114. An indoor coil 116 is provided. During the heating cycle, the water flow passes through a condenser so as to condense the refrigerant. This condensed water is then passed through an evaporator so as to evaporate the condensed refrigerant. The compressor 114 serves to compress the evaporated refrigerant in order to cause a cooling effect by the indoor coil. The water can be passed back to the swimming pool 12.

The heating cycle, the remaining portion of the water passing along line 42 is delivered to the evaporator of the heat pump 18. The evaporator serves to evaporate the refrigerant. This evaporated refrigerant can then be condensed so as to produce a condensed refrigerant. The condensed refrigerant is then compressed so as to achieve a heating effect by the heat pump 18. The water can then be returned to the swimming pool.

The transformer within a control panel powers the low voltage controls of the heat pump. The transformer is associated with the appropriate valves. A high voltage relay will control the valve 98 so as to turn the valve 98 on when the timer signals by closing the water valve 98 relay contact. The system operates by a call from the thermostat for cooling so as to open the reversing valve 118 to cool within the heat pump unit 18. The water control valve 50 is energized so as to open to allow water flow to the heat pump 18 at the same time that the other valve is deenergized so as to allow water flow to the heat pump and shut off the flow from the pool until the water passes through the heat pump 18. The compressor of the heat pump starts when sufficient water flow is proven through the pressure safety switch 52. When the conditioned space temperature is achieved, the heat pump 18 shots off and the water valve 50 closes so as to stop water from going to the heat pump on the off cycle. If the timer signals the pool pump 14 to be on for normal skimming, without a call for heating or cooling, a water valve relay will close so as to open the water valve so as to allow water to go to the pool 12.

On a demand for heat, the same thing occurs, but this time the reversing valve 118 is not energized and the evaporator in the attic or closet becomes the condenser and the condenser becomes the evaporator so as to absorb heat from the pool 12. During the cooling cycle, heat is absorbed in the pool from the house.

Importantly, the present invention employs a single heat pump. If more than one heat pump were employed in the system of the present invention, it would overtax the elements and fail to achieve the requisite energy efficiency. In fact, the addition of more than one heat pump to the system would actually result in a lower efficiency rating than the use of a conventional heat pump. As such, within the concept of the present invention, is contemplated that the pumping system associated with the swimming pool be used in association with only a single heat pump.

Importantly, the various hand valves or modulating valves are required by the system of the present invention in order to allow the pressures to be precisely controlled. As such, the extremely high energy efficiency rating can be achieved. Specific pressures through the system will need to be achieved in order to get the high energy efficiency ratios for air-conditioning or a coefficient of performance for heating. As such, the present invention provides a highly technical system designed to maintain the specific pressures. The maintenance of the critical pressures allows the system to work better than any other system by using only a single water source heat pump, a single swimming pool, a single pool pump and a single pool cooler.

The pool cooler fan only runs at night when the thermostat shows a temperature of 85° F. This is accomplished through the use of a timer in parallel with the pool pump timer. The swimming pool pump in the system can only run at between 10 and 30 p.s.i.g. This would usually run through a 1.5 or 2 inch PVC line. This will go through the filter into the pool and back to the pool pump. When designing a system to heat and cool a house while still keeping the water cool for an enjoyable swim, it is critical to maintain between 2 and 3 p.s.i.g. of pressure at the water source heat pump to heat and cool a house properly, as explained hereinabove. As such, the present invention utilizes several hand or modulating valves in order to achieve the specific pressures.

The valve 52 is utilized so as to maintain the pressure of between 2 and 3 p.s.i.g. to the heat pump. This will net the proper gallons per minute to the heat pump of between 1.5 to 2 gallons per minute per ton. This is required for a high energy efficiency rating or a high coefficient of performance. If the pressure is too low, the system will not run at all. The pressure switch 52 will go off on high pressure and have a low temperature drop across the heat pump 18. When the pump starts the flow of water through the filter 40 and the valve mechanism 34, a pressure of around 20 p.s.i.g. is created when cooling or heating is required. The hand or modulating valve 93 is critical so as to maintain 4 to 6 p.s.i.g. of pressure to the inlet line 81 of the pool cooler and still control pressure to the heat pump into the pool.

The pool cooler is only designed to run at night. It does not run for 24 hours a day in the summer. The check valve 85 ensures that the water goes in only a single direction. The hand or modulating valve 87 will have enough pressure to allow the spray wands to turn. If this pressure is not maintained on line 79, the wands will not turn or the pool cooler will overflow. There is also a hand or modulating valve 83 on line 79. This is only a one inch line originating from line 72 from the heat pump 18 in order to have sufficient pressure to mix with inlet line 81. This will be about 2 p.s.i.g. mixing with between 4 and 6 p.s.i.g. in line 81. There is also a hand or modulating valve 89 coming from the pool cooler in order to maintain this 4 to 6 p.s.i.g. of pressure. This is a critical pressure controlled mechanical system that is designed to maintain specific pressures for the heat pump in order to get a high energy efficiency ratio. The maintenance of these critical pressures allows the achieving of a high coefficient of performance for heating.

The energy efficiency ratio is determined by the following formula:

$$EER = \frac{\text{Cooling Rate } BTU}{\text{Electrical Energy (Consumption Rate Kilowatt)}}$$

The energy efficiency ratio of an air-cooled air-conditioning system and heat pump is highly dependent on outside air temperature being drawn across the outdoor condenser coil and decreases with the increase of outdoor air temperature. The highest energy efficiency ratio that can be achieved is around 13 EER. Presently, a ground source heat pump can perform at 25 EER or more. The EER of a geothermal heat pump is dependent on the cooling rate of BTU/hr. The BTU/hr is calculated by the following formula:

Heat of Extraction=BTU/hr=Flow(gpm)=temp in and Temp out×fluid rate

An open loop system is 1.5 gallons per minute×2 gallons per minute per ton. A four ton system would have 6-8 gallons per minute times 10 "TD"×500 for a total of 40,000 BTUs. The power is calculated at 8 amps×248 volts×0.9 power factor so as to produce 1785.6 watts and an energy efficiency ratio of greater than 22.4. In contrast, if the pressure is not precisely controlled, then the formula is calculated as 10 gallons per minute times 5.5 TD×500 for 27,500 BTUs. This would equal in energy efficiency ratio of 15.4.

In the case of heating, the coefficient of performance would be calculated as a gallons per minute×10 TD×500 or 40,000 BTUs per hour. The power consumption would be 248×8×0.9 power factor×3.412 so as to equal 6,042 kilowatt. As such, there would be 3412 BTUs per kilowatt so as to produce a coefficient of performance of 6.565. This is significantly larger than the typical coefficient of performance of approximately 3.6 for heating systems. As such, the present invention is able to achieve energy efficiency both in the cooling cycle and in the heating cycle. In actual power usage, this would be approximately 53% less electrical usage than with conventional systems. As such, this information establishes that control of pressure is critical in order to achieve the significant energy efficiency advantages and coefficient of performance advantages of the present invention.

The foregoing disclosure and description of the invention is illustrative and explanatory thereof. Various changes in the details of the illustrated construction or in the steps of the described method can be made within the scope of the present invention without departing from the true spirit of the invention. The present invention should only be limited by the following claims and their legal equivalents.

I claim:

1. A heating and cooling system comprising:

a swimming pool having water therein;

a pump in fluid communication with the water in said swimming pool, said pump suitable for drawing water from said swimming pool therethrough, said pump having an inlet pipe and an outlet pipe connected thereto;

a pool cooler suitable for cooling water passing therethrough, said pool cooler having an inlet line and an outlet line connected thereto, said outlet line communicating with said inlet pipe of said pump, said outlet line having a pressure control thereon so as to reduce a pressure of the water flowing from said outlet line to said inlet line of said pump, said inlet line having a pressure valve thereon so as to reduce a pressure of the water flow to between 4 and 6 p.s.i.g.;

a water source heat pump cooperative with said pump so as to receive water as passed by said outlet pipe of said pump, said water source heat pump having a first line and a second line extending therefrom, said first line having a modulating valve thereon so as to control a flow of the water to said water source heat pump, said water source heat pump having a condenser and an evaporator and a compressor with a reversing valve cooperative therewith;

a valve mechanism connected to said outlet of said pump so as to control the flow of water toward said pool cooler and to said water source heat pump; and a pressure control valve cooperative between said valve mechanism and said inlet line of said pool cooler so as to limit a pressure of the water flowing from said valve mechanism toward said inlet line of said pool cooler to a pressure of between 8 and 10 p.s.i.g. and to assure that at least 2 p.s.i.g. of water flows from said valve mechanism to said water source heat pump, said pressure control of said outlet line of said pool cooler limiting a pressure of the water flow from said pool cooler to said pump to between 0.25 p.s.i.g. and 0.50 p.s.i.g.

2. The heating and cooling system of claim 1, further comprising:

a bypass line connected to said inlet line of said pool cooler and downstream of said pressure control valve so as to allow a flow of water from said inlet line to pass therein.

3. The heating and cooling system of claim 1, further comprising:

a filter cooperative with said valve mechanism so as to filter the water from said pump, said filter having an outlet suitable for passing between 8 and 9 p.s.i.g. of water therefrom.

4. The heating and cooling system of claim 1, said outlet line of said pool cooler having a modulating valve thereon suitable for bleeding a flow of water through said outlet line to said inlet pipe of said pump when said heat pump is in a heating mode.

5. The heating cooling system of claim 1, said reversing valve movable between a first position and a second position, said first position for passing refrigerant through said condenser and through said evaporator during a cooling mode, said second position for passing the refrigerant to said evaporator and through said condenser during a heating mode.

6. The heating and cooling system of claim 1, said modulating valve of said water source heat pump for limiting of flow of water to said water source heat pump to between 1.5 and 2 p.s.i.g. per ton.

7. The water source heat pump of claim 1, further comprising:

a valve controller connected to a conduit extending from said swimming pool and to said inlet pipe of said pump and cooperative with said outlet line of said pool cooler so as to selectively pass cool water from said pool cooler to said swimming pool.

8. The heating cooling system of claim 1, said water source heat pump being a single water source heat pump.

9. A heating and cooling system comprising:

a swimming pool having water therein;

a pump in fluid communication with the water in said swimming pool, said pump suitable for drawing water from said swimming pool therethrough, said pump having an inlet pipe and an outlet pipe connected thereto;

a pool cooler suitable for cooling water passing therethrough, said pool cooler having an inlet line and an outlet line connected thereto, said outlet line communicating with said inlet pipe of said pump, said outlet line having a pressure control thereon so as to reduce a pressure of the water flowing from said outlet line to said inlet line of said pump, said inlet line having a pressure valve thereon so as to reduce a pressure of the water flow to between 4 and 6 p.s.i.g.;

a water source heat pump cooperative with said pump so as to receive water as passed by said outlet pipe of said pump, said water source heat pump having a first line and a second line extending therefrom, said first line having a modulating valve thereon so as to control a flow of the water to said water source heat pump, said water source heat pump having a condenser and an evaporator and a compressor with a reversing valve cooperative therewith;

a valve mechanism connected to said outlet of said pump so as to control the flow of water toward said pool cooler and to said water source heat pump; and a pressure control valve cooperative between said valve mechanism and said inlet line of said pool cooler so as to limit a pressure of the water flowing from said valve mechanism toward said inlet line of said pool cooler to a pressure of between 8 and 10 p.s.i.g. and to assure that at least 2 p.s.i.g. of water flows from said valve mechanism to said water source heat pump, said valve mechanism having a controller cooperative therewith so as to selectively cause water to flow from said water source heat pump to said pool cooler or to cause water to flow from said water source heat pump to said swimming pool, said controller cooperative with said reversing valve of said water source heat pump so as to control the flow of refrigerant to said evaporator so as to absorb heat from the water upon a demand for heat.

10. The heating and cooling system of claim 9, further comprising:

a temperature sensor cooperative with the water in said swimming pool so as to sense a temperature of the water in said swimming pool, said temperature sensor cooperative with said valve mechanism so as to cause a blockage of the flow of water through said outlet line of said pool cooler when a sensed temperature of the water in said swimming pool is less than 85° F.

11. The heating and cooling system of claim 1, further comprising:

an UV light source cooperative between said swimming pool and said water source heat pump and said pump.

12. A process comprising:

pumping water from a swimming pool toward a water source heat pump;

diverting at least a portion of the flowed water into an inlet line of a pool cooler, the diverted pressure being between 8 and 10 p.s.i.g.;

reducing the pressure of the diverted portion to between 6 p.s.i.g. to 8 p.s.i.g.;

flowing the reduced pressure water into a pool cooler so as to cool the water; and passing the cooled water to the swimming pool when a temperature of the water in the swimming pool is above 85° F.

13. The process of claim 12, further comprising:

passing the remaining portion of the diverted water toward the water source heat pump.

14. The process of claim 13, further comprising:

passing the remaining portion through a condenser so as to condense a refrigerant; and passing the condensed refrigerant through an evaporator of said water source heat pump so as to evaporate the condensed refrigerant;

compressing the evaporated refrigerant so as to compress the evaporated refrigerant so as to cause a cooling effect; and discharging the water back to said swimming pool.

15. The process of claim 13, further comprising:

passing the remaining portion through an evaporator so as to evaporate a refrigerant;

condensing the evaporated refrigerant so as to condense the refrigerant;

compressing the condensed refrigerant so as to cause a heating effect; and discharging the water to the swimming pool.

16. The process of claim 12, further comprising:

reducing a pressure of the diverted portion to between 4 to 6 p.s.i.g. prior to entering the pool cooler.

17. The process of claim 12, further comprising:

blocking a flow of the cooled water when the sensed temperature is less than 85° F.

18. The process of claim 12, further comprising:

constantly operating said pool cooler regardless of the sensed temperature of the water in the swimming pool.

* * * * *